US005153653A

United States Patent [19]

Fuma et al.

[11] Patent Number: 5,153,653

[45] Date of Patent: Oct. 6, 1992

[54] IMAGE FORMING APPARATUS

[75] Inventors: Hiroshi Fuma; Mitsuo Motohashi; Yozo Fujii; Akihiko Kakita; Takashi Murahashi; Kazuo Yasuda; Yoshio Yamazaki; Masashi Sugano, all of Hachioji, Japan

[73] Assignee: Konica Corporation, Tokyo, Japan

[21] Appl. No.: 631,392

[22] Filed: Dec. 20, 1990

[30] Foreign Application Priority Data

| | | | |
|---|---|---|---|
| Dec. 25, 1989 | [JP] | Japan | 1-335495 |
| Dec. 25, 1989 | [JP] | Japan | 1-335496 |
| Dec. 25, 1989 | [JP] | Japan | 1-335497 |
| Feb. 1, 1990 | [JP] | Japan | 2-22945 |

[51] Int. Cl.[5] ..... G03G 15/16

[52] U.S. Cl. ..... 355/275; 355/273; 355/274

[58] Field of Search ..... 355/272, 273, 274, 275, 355/276, 277, 281

[56] References Cited

U.S. PATENT DOCUMENTS

| | | | |
|---|---|---|---|
| 3,357,325 | 10/1965 | Eichorn et al. | 355/274 X |
| 4,407,580 | 10/1983 | Hashimoto et al. | 355/275 |
| 4,931,839 | 6/1990 | Tomkins et al. | 355/277 |

FOREIGN PATENT DOCUMENTS

| | | | |
|---|---|---|---|
| 0097976 | 4/1988 | Japan | 355/275 |
| 0249873 | 10/1988 | Japan | 355/275 |
| 0276159 | 11/1989 | Japan | 355/277 |
| 0010389 | 1/1990 | Japan | 355/275 |

*Primary Examiner*—Richard L. Moses
*Assistant Examiner*—P. Stanzione
*Attorney, Agent, or Firm*—Frishauf, Holtz, Goodman & Woodward

[57] ABSTRACT

The invention provides an apparatus for transferring a toner image from a photoreceptor to a recording sheet. The apparatus includes a plurality of rollers and a belt stretched around the plurality of rollers. The belt is adapted to come in contact with the photoreceptor at a transfer area so that a recording sheet is conveyed on the belt and brought in contact with the image surface at the transfer area and that the toner image is transferred onto the recording sheet. The apparatus further includes a conductive member, disposed so as to come in contact with the belt on one of the plurality of rollers which is positioned upstream in conveying direction than the transfer area, for charging the recording sheet conveyed on the belt.

16 Claims, 4 Drawing Sheets

IMAGE FORMING APPARATUS

BACKGROUND OF THE INVENTION

The invention relates to an image forming apparatus, such as an electrophotographic copying machine, equipped with a transferring belt device for electrostatically supporting and conveying a transfer material to an image carrying member and for further conveying the transfer material to a fixing means after a toner image on the image carrying member has been transferred onto the transfer material.

FIG. 7 is a sectional views showing an electrophotographic copying machine as one example of a conventional image forming apparatus. In the drawing, numeral 10 indicates a photoreceptor drum, carrying means, and numeral 20 indicates a charging device for charging the circumferential surface of photoreceptor drum 10. There are further provided exposure device 30, image exposure station 13, developing device 40, transfer sheet feeding device 50, sheet feeding roller 53, transferring device 16 which is a charging device used for transferring, separating device 17 which is a charge eliminating device for separation, fixing device 80, and cleaning device 90. The mark P represents a recording sheet as a transfer material. Numeral 56 indicates a conveying belt as conveying means for recording sheet P.

This copying machine works as follows. After charging device 20 charges evenly the circumferential surface of photoreceptor drum 10, exposure device 30 exposes the circumferential surface of photoreceptor drum 10 at image exposure station 13 to form an electrostatic latent image on it. Thereafter, the latent image is developed to form a toner image. The toner image is transferred, with controlled timing, onto recording sheet P which is fed by sheet feeding roller 53 of transfer sheet feeding device 50. This transferring operation is carried out in such a manner that transferring device 16 charges the reverse side of recording sheet P with the polarity opposite to the charged polarity of the toner. After this transferring operation, recording sheet P is neutralized by the application of high A.C. voltage by separating device 17 so that recording sheet P is separated from photoreceptor drum 10. The separated recording sheet P is conveyed to a fixing device by conveying belt 56 to fix the toner image, and then discharged to a delivery tray outside of the machine.

After transfer of the toner image, toner remaining on the circumferential surface of photoreceptor drum 10 is cleaned by cleaning device 90, and then photoreceptor drum 10 is made ready for the next copying operation.

However, in the above constitution, in order to ensure the transferability and separability of the toner image, the best working point needs to be set by the adjustment of electric discharge efficiency between transferring device 16 and separating device 17. Further, there is a problem in that, as the electric discharge efficiency is influenced by the environment, the allowable range for reliability is too narrow. The transferability depends on the charges held on recording sheet P and the mechanical characteristics of recording sheet P, such as stiffness, surface smoothness and the extent of curl orientation. Since these factors are greatly influenced by the storage conditions of recording sheet P and the environment (temperature, humidity) at the time of transferring, it may be difficult to maintain good conditions at all times.

Furthermore, when recording sheet P moves to conveying belt 56, the recording sheet is returned into it's original flat condition. When the diameter of photoreceptor drum 10 is fairly large, curvature of recording sheet P is smaller than when the photoreceptor diameter is small. This curved recording sheet P onto which a toner image has been transferred, is apt to adhere onto photoreceptor drum 10, so that sheet jamming may often take place. Accordingly, this conventional type image forming apparatus has a disadvantage in that the sheet passing capability of its mechanism may be low.

As a technique which has improved the above disadvantage, U.S. Pat. No. 3,357,325 discloses a belt type transfer conveyance apparatus as shown in FIG. 8.

In FIG. 8, numeral 10 indicates a photoreceptor drum as a drum-shaped image carrying member, 70*a* a transferring belt device as a belt-shaped transfer and convey means, 71 a transferring belt for attracting a transfer material by its holding charges, 72 and 73 are rollers for supporting, stretching and rotating the transferring belt 71, 60 a pretransfer sheet charging device for applying a corona discharge to electrostatically attract recording sheet P onto transferring belt 71, 16 a transferring device as a charging device for transferring a toner image from photoreceptor drum 10 onto recording sheet P, 160 a transferring point. With this constitution, recording sheet P can be conveyed by being attracted onto transferring belt 71 so that excellent transfer and separation efficiencies may be obtained at transferring point 160.

Transferring belt device 70*a* may be a preferable device for a color image forming apparatus in which toner images are formed by being superimposed on photoreceptor 10 and are transferred at one time onto recording sheet P. In a color image forming apparatus, in order to superimpose toner images on photoreceptor 10, a plurality of developing devices need to be installed around the periphery of photoreceptor drum 10, and thereby the drum diameter becomes inevitably larger. Accordingly, since a sufficient separation performance may not be obtained by a conventional electrostatical transfer-separation method, the apparatus needs an enhanced method to ensure separation performance. Furthermore, since the adhering amount of toner may be increased so that a large amounts of transferring charge may be required, the apparatus needs to have the capability of holding the large amounts of transferring charge. For the above two requirements the transferring belt device performs well.

In transferring belt device 70*a* shown in FIG. 8, recording sheet P is charged by pre-transfer sheet charging device 60 before transferring, and then is conveyed by running transferring belt 71, being attracted thereto. A charging device of a corona-discharge type has conventionally been used as aforesaid pre-transfer sheet charging device 60.

In a charging device of a corona-discharge type, however, when a recording sheet enters below discharging electrode 62 without being attracted fully to transferring belt 71, it has caused problems that the recording sheet is not charged fully, the recording sheet can not be separated fully from photoreceptor drum 10, and the leading edge of recording sheet P curves and advances toward discharging electrode 62 of pretransfer sheet charging device 60, resulting in the snapping of a wire and a short circuit. Even in the case of the technology disclosed in Japanese Patent Publication Open to Public Inspection Nos. 121878/1989 and 121879/1989 (hereinafter referred to as Japanese Patent O.P.I. Publication), a recording sheet is charged through corona discharge and therefore the aforesaid problems are not solved. In order to solve the problems, there is a method wherein a plate member is provided at the upstream side of shielding member 61 so that recording sheet P can advance properly, which, however, is not satisfactory because charging in this method is not uniform.

Further, discharging electrode 62 composed of a thin wire tends to be contaminated while it is used, which causes uneven discharging that results in uneven charges given to recording sheet P. When transferring is made under such condition, uneven transferring corresponding to uneven discharging of pre-transfer sheet charging device 60 is created, which has been a problem.

In reversal development, which has been recently widely used, the use of charging with negative polarity has increased. In this type, when negative polarity charging is performed by corona charging, recording sheets are apt to be charged unevenly, resulting in the above problems.

Further, the force for recording sheet P to be attracted to transferring belt 71 is reduced by transfer charging made for transferred toner images, and the recording sheet tends not to be separated from photoreceptor drum 10, which has been a problem.

Further, in the conventional apparatus, ozone is generated due to corona discharge, thus deteriorating transferring belt 71 and affecting adversely on human bodies, which has also been a problem.

The first object of the invention is to solve foresaid problems and to provide a transferring belt device wherein recording sheet P advances properly onto transferring belt 71, uniform pre-transfer sheet charging is made, recording sheet P is attracted properly to transferring belt 71, thus uneven transferring is not created and less ozone is generated.

A charging device is well known wherein an elastic brush made of elastic conductive fiber materials is used as the charging means and is applied with an electric voltage. However, the tip of the elastic brush needs to be brought in contact with an object to be charged under a constant pressure. Accordingly, the elastic brush may collect dust on the belt, or may lose its elasticity and become curled after it has been used over a long period, causing uneven pressure contact and resulting in shorter life.

An object of the invention is to solve the above-mentioned problems and to provide an image forming apparatus being excellent in both transferability of a toner image and separability of recording sheets from a photoreceptor drum, wherein the apparatus is equipped with a transferring belt device capable of making the life of an elastic brush longer.

In case of the ambient condition for usage of high humidity, the resistance value between the ground and the apparatus is not infinity even when DC power source is turned off, resulting, therefor, in leakage of charges for transferring that easily takes place through transferring belt 71, recording sheet P and an elastic brush. Therefore, sufficient charges for transferring are not obtained, and transfer efficiency is lowered, and proper transferring can not be performed, which has been a problem.

The third object of the invention is to solve aforesaid problems with a simple constitution and to offer an image forming apparatus wherein uniform charging for transferring is made and characteristics of transferring and separation are uniform.

SUMMARY OF THE INVENTION

Aforesaid first object of the invention is achieved, in a transferring belt device wherein a belt that is spread between holding rollers for running is caused to touch an image carrier with a transfer material between them, and toner images on the image carrier are transferred onto the transfer material which then is conveyed, by causing a conductive member made, for example, of an elastic brush and is impressed with a prescribed voltage with aforesaid belt sandwiched therebetween to be in contact with a holding roller positioned at the upstream side of a transferring portion, and thus, by causing aforesaid transfer material to be sandwiched between aforesaid belt and aforesaid dielectric member and to be conveyed.

In aforesaid image forming apparatus, it is preferable that aforesaid transfer material is charged and aforesaid transferring device is operated so that aforesaid transfer material has on its leading edge a non-transfer area.

In an image forming apparatus which uses a rotatable transferring belt stretched around support rollers, which forms a toner image on an image carrying member, and which transfers the toner image on a moving transfer material at its transferring point and conveys the transfer material. The above object may be attained by the image forming apparatus characterized in that: a conductive material applied with a predetermined voltage is provided so as to opposite via the transferring belt to the support roller positioned at the upstream side of the transferring point of the transferring belt, and that, when a transfer material passes through, the conductive material is applied with a bias voltage to charge the transfer material so as to hold and convey the transfer material between the conductive material and the belt, and when no transfer material passes through, the conductive material is adapted to separate from the belt.

Aforesaid third object of the invention is achieved, in an image forming apparatus wherein a transferring belt that is spread between holding rollers for running is used, toner images are formed on an image carrier, and the toner images are transferred, at a transferring portion, onto a running transfer material which then is conveyed, by providing a conductive members facing each other with aforesaid belt between them and impressed with prescribed voltage on a holding roller positioned at the upstream side of the transferring portion of aforesaid transferring belt, by charging aforesaid transfer material for the predetermined distance from the leading edge of aforesaid transfer material by impressing specified bias voltage thereon, and by providing in series a Zener diode between aforesaid conductive member and the power source for charging aforesaid transfer material.

DETAILED DESCRIPTION OF THE PREFERRED EMBODIMENTS

Figure 1:
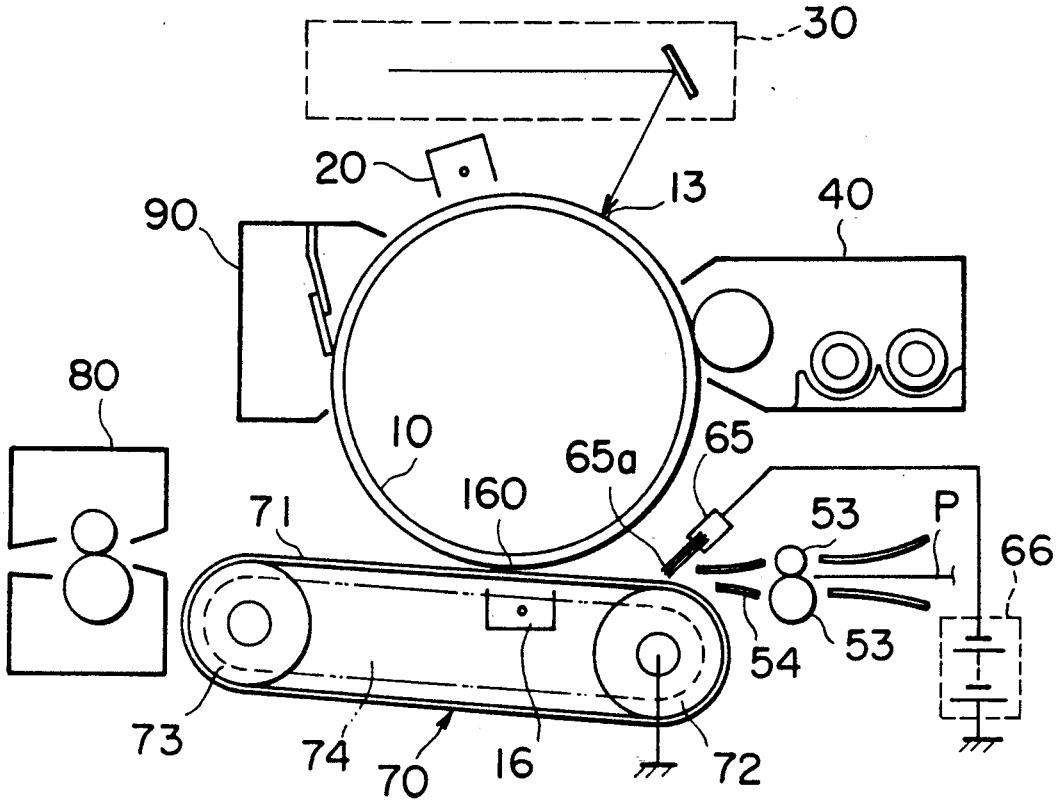
FIG. 1 is a sectional schematic view showing an example of an image forming apparatus according to the invention.
Figure 2:
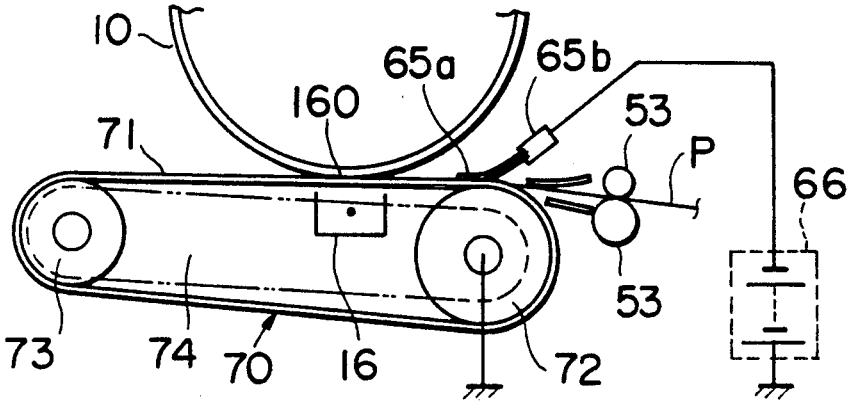
FIG. 2 is a sectional schematic view indicating a working condition of a transferring belt.

FIG. 1 is a sectional schematic view showing an example of an image forming apparatus according to the invention, and FIG. 2 is a sectional schematic view indicating a working condition of a transferring belt.

Figure 4:
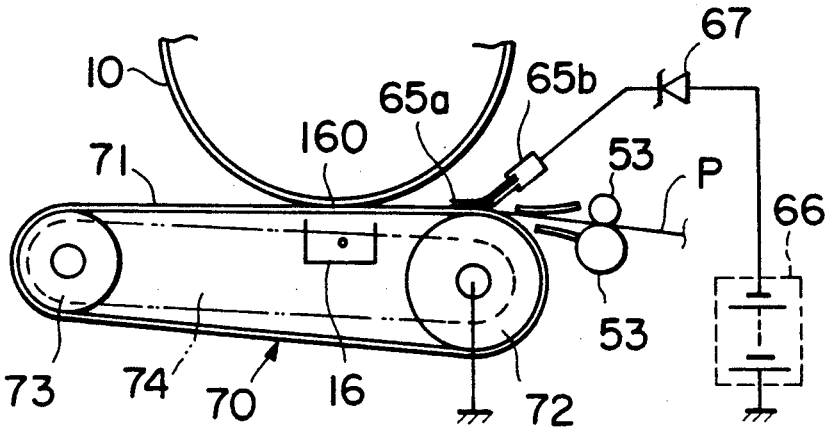
FIG. 4 is a sectional constitution diagram showing other example having therein an elastic brush installed.
Figure 5:
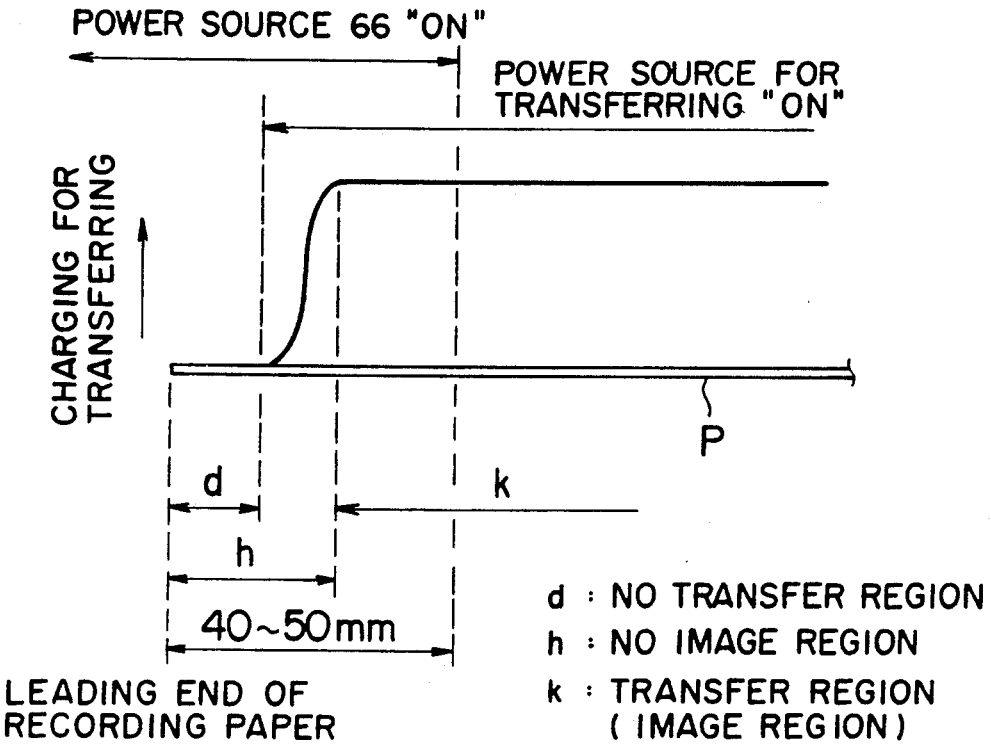
FIG. 5 is a side view showing the leading edge portion of recording sheet P similarly to FIG. 3.

In the drawings, the same parts as those in the conventional image forming apparatus and transferring belt device 70*a*, as shown in FIGS. 4 and 5, are represented by the same symbols, and detailed descriptions for the same parts will be omitted, because their actions are substantially the same.

Numeral 54 indicates a guide plate disposed between sheet feeding roller 53 and supporting roller 72; 70 a transferring belt device; 65 an elastic brush which is disposed at the upstream side of transferring part 160 in the apparatus body and made of conductive fibers as a conductive member for performing pre-transfer sheet charging; and 66 a power source for applying a bias voltage to elastic brush 65. A protective resistance may be inserted in series between elastic brush 65 and power source 66 to prevent current when elastic brush 65 should be grounded.

Supporting rollers 72,73 are made of conductive metal members. Supporting roller 72, disposed at the upstream side, is grounded or provided with a predetermined potential close to the ground condition. Numeral 74 indicates a roller supporting member which is shown by a dotted line. One side of roller supporting member 74 is associated with a shaft of supporting roller 73 as the fixed axis, and the other side is coupled with a movable shaft of supporting roller 72. When a transferring operation is not performed, supporting roller 72 is biased by an elastic member, not shown in the drawings, so as to take a lower position as illustrated in FIG. 1. Thereby transferring belt 71 is separated from the periphery of photoreceptor drum 10. In this condition, elastic brush 65 is positioned so that its brush tip separates from or is slightly in contact with transferring belt 71. Therefore, dirt adhesion may become very little, and since elastic brush 65 is usually located in a separated position, elastic brush 65 does not gradually lose its elasticity over a long period and become curled. Accordingly, charging may be carried out evenly and the life of the elastic brush may be prolonged.

During a period of transferring, roller supporting member 74 is rotated counterclockwise against the force of aforesaid elastic member by components such as solenoids and motors, for example, operated through the control by the controlling portion in an apparatus main body, and thereby transferring belt 71 is caused to be in contact with photoreceptor drum 10 and bristle tip 65*a* of elastic brush 65.

Incidentally, the invention can also be embodied on the constitution wherein elastic brush 65 is not fixed on the apparatus main body, but is provided on roller supporting member 74 through an attaching member rotatably around its base portion 65*b* (FIG. 2) and energized so that bristle tip 65*a* is separated from transferring belt 71 during a period of non-transferring, while a, solenoid or the like, for example, is operated through the control of the controlling portion so that elastic brush 65 is rotated so that bristle tip 65*a* of elastic brush 65 is caused to be in pressure-contact with transferring belt 71 with a predetermined pressure.

As a conductive fiber of elastic brush 65, a wire of stainless steel can also be used, but in the present example, satisfactory results are obtained by using carbon-containing rayon having the volume resistivity of $10^4$–$10^6$ ohm-cm.

The foresaid guide plate 54 can be eliminated by arranging sheet feeding roller 53 in the vicinity of supporting roller 72.

Further, with regard to the constitution of the aforesaid transferring belt 71, the main body thereof is a high-resistant sheet in thickness of about 0.5–1.0 mm and of an endless type composed of two layers, for example, having the volume resistivity of about $10^{10}$ ohm-cm, such as one made of silicone rubber, polyurethane rubber and butyl rubber, and its top surface is sprayed with fluorine-contained resins to reduce frictional resistance and to prevent contamination.

Next, operations of aforesaid transferring belt device 70 will be explained. Concurrently with the start of rotation of sheet feeding roller 53, transferring belt 71 that is already running concurrently with the start of copying operation is caused to be in contact with photoreceptor belt 10, elastic brush 65 is caused, by the aforesaid mechanism, to be in contact with transferring belt 71, and bias voltage for pre-transfer sheet charging is applied by power source 66. A leading edge of recording sheet P is fed by sheet feeding roller 53 into the portion between elastic brush 65 and transferring belt 71. Here, recording sheet P is charged uniformly, being injected with charges by elastic brush 65, and then is conveyed to transferring part 160, being attracted to transferring belt 71. At the point when the leading edge of recording sheet P has passed through transferring part 160 by a certain length (e.g., 5 mm), a power source for transferring in transferring device 16 is turned on for the start of transferring of toner images. After transferring is finished, transferring belt 71 is separated by the aforesaid elastic member from photoreceptor belt 10 and elastic brush 65.

Figure 3:
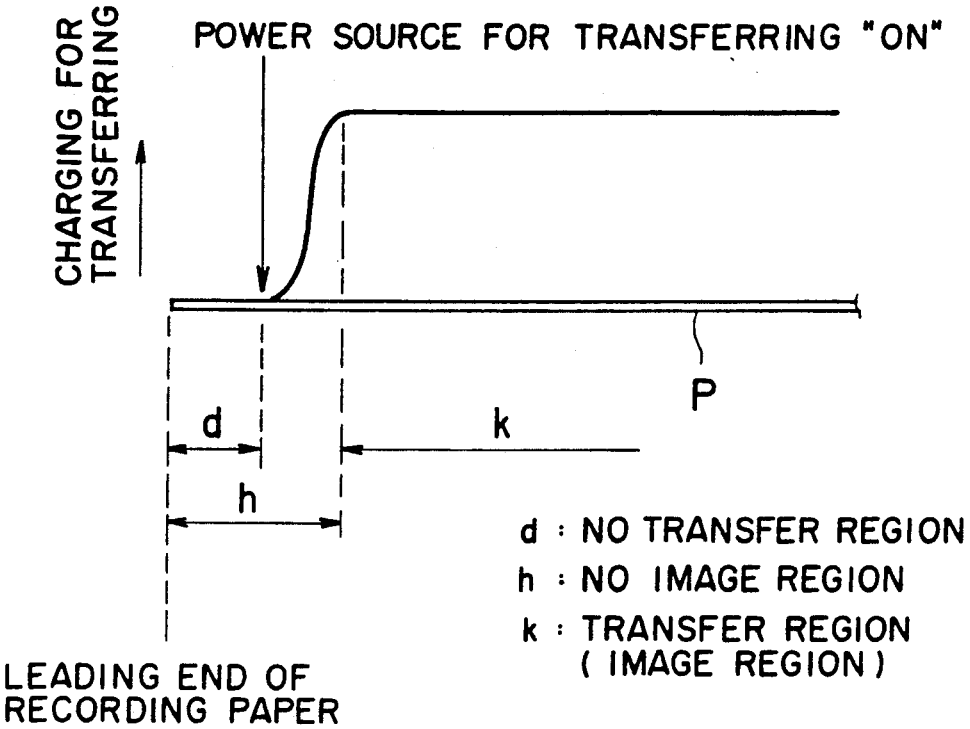
FIG. 3 is an enlarged side view showing a leading end of recording sheet P obtained by the image forming apparatus of the invention.

As shown in FIG. 3, non-transferring area d and non-image area h are formed on the leading edge of recording sheet P through the aforesaid operation control. The start of scanner-reading for image-reading or the start of printer-writing is slightly delayed through the process control so that the leading edge of an image agrees, in terms of position, with the edge of transferring area k (image area) that is slightly deviated backward by the formation of aforesaid non-image area h.

Thus, non-transferring area d whose length is several millimeters, 5 mm, for example is formed on the leading edge of recording sheet P, and then transferring voltage is impressed so that transferring characteristic becomes sufficient during a period after the non-image area h following the non-transferring area d passes the transferring part 160.

Since the non-transferring area d of the aforesaid recording sheet P is kept to be in the state of being charged by elastic brush 65, the recording sheet P is firmly attracted, even after transferring of toner images, to transferring belt 71, resulting in an excellent characteristic for separating from photoreceptor drum 10. Further, since uniform pre-transfer sheet charging is performed on transferring area k by elastic brush 65, transferring charging is conducted uniformly, resulting in uniform and excellent transferring.

Bias voltage to be impressed on aforesaid elastic brush 65 is allowed to be low enough compared with corona discharge, resulting in a cost reduction of power source 66. Further, since recording sheet P is injected directly with charges for charging without corona discharge, no ozone is generated and deterioration of life of transferring belt 71 is lessened and human bodies are less affected adversely, which is an advantageous point.

In an image forming apparatus of the present example, aforesaid elastic brush 65 is provided in a position facing supporting roller 72 grounded or is close to grounded condition, and thereby recording sheet P fed from transfer sheet feeding device 50 is charged efficiently and firmly. Further, since the distance to transferring part 160 is short, the reduction of charges caused by leakage of charges during transport is small, thus transferring belt 71 attracts firmly recording sheet P for the transport thereof.

Further, since elastic brush 65 is impressed with bias voltage whose polarity is the same as that of charges on toners in developers, toners on photoreceptor drum 10 are not attracted to recording sheet P until recording sheet arrives at transferring part 160. Therefore, it is possible to obtain a clear copy quality. With regard to the impression of bias voltage mentioned above, the control is made for constant voltage so that it is 0.5-2.0 KV (same polarity as that of toner) when the linear speed on the circumferential surface of photoreceptor drum 10 is 140 mm/sec, the width of image is 300-350 mm and the thickness of sheet is 65 g/m$^2$.

Further, transferring device 16 is impressed with high voltage whose polarity is opposite to that of toner charging under the constant current control for transferring of toner images. This constant current control is switched, for to 300 $\mu$A for high humidity and to 200 $\mu$A for low humidity for charging. Therefore, the current for charging is changed based on the change of humidity affecting most, which, together with uniform pre-transfer sheet charging, realizes the constant and firm attraction and transport force which are not affected by ambient conditions, and thus, high transfer efficiency are obtained.

Other example relating to installation of conductive member will be explained, next.

In FIG. 4, 65 is an elastic brush that is an conductive member for charging transfer material made of conductive fiber material and fixed at the upstream side of transferring part 160 on an apparatus main body, 66 is DC power source for charging transfer material for applying bias voltage on elastic brush 65, numeral 67 is a Zener diode inserted between elastic brush 65 for preventing leakage current stated later and DC power source 66.

As is shown in FIG. 5, transferring of toner images is started by turning on power source for transferring of unillustrated transferring device 16 at the point when the leading edge of recording sheet P has passed transferring part 160 by a certain length (e.g., 5 mm). After this, at the point when the area of 40-50 mm from the leading edge on recording sheet P has been charged, DC power source 66 for transfer material charging is turned off, and aforesaid Zener diode 67 prevents the leakage of charges for transferring through recording sheet P and elastic brush 65 except a small amount of leakage current (from 1 $\mu$A up to 5 $\mu$A). Therefore, the normal transferring voltage can be kept.

Thus, due to the effect of Zener diode 67, charges for transferring leak less, charging for transferring can be done uniformly, and thus extremely excellent transferring without any unevenness can be performed.

Figure 6:
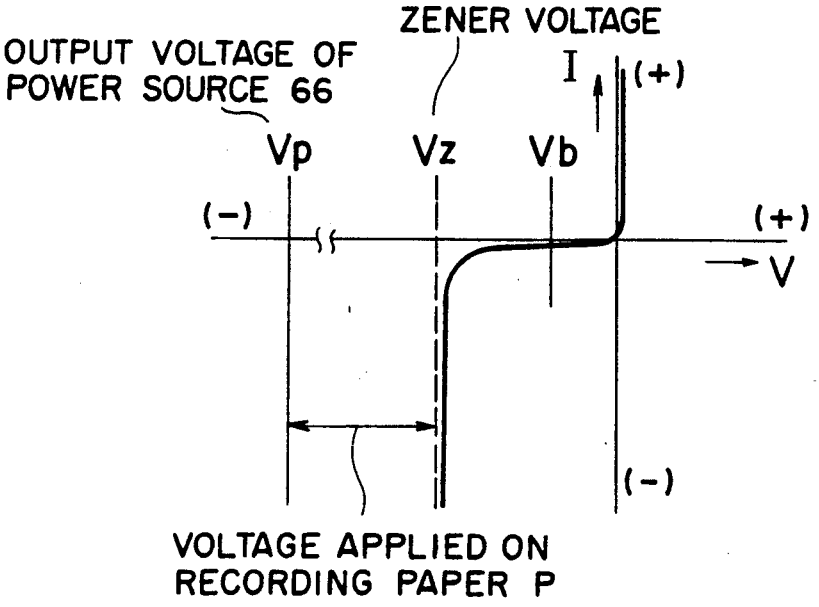
FIG. 6 is a characteristic diagram of a Zener diode shown in FIG. 4.
Figure 7:
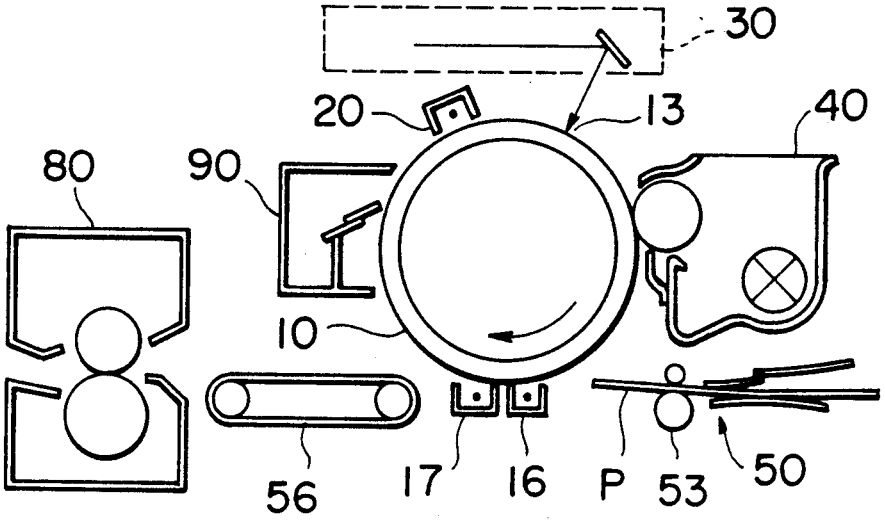
FIG. 7 is a sectional schematic view showing a constitution of a conventional electrophotographic copying machine.
Figure 8:
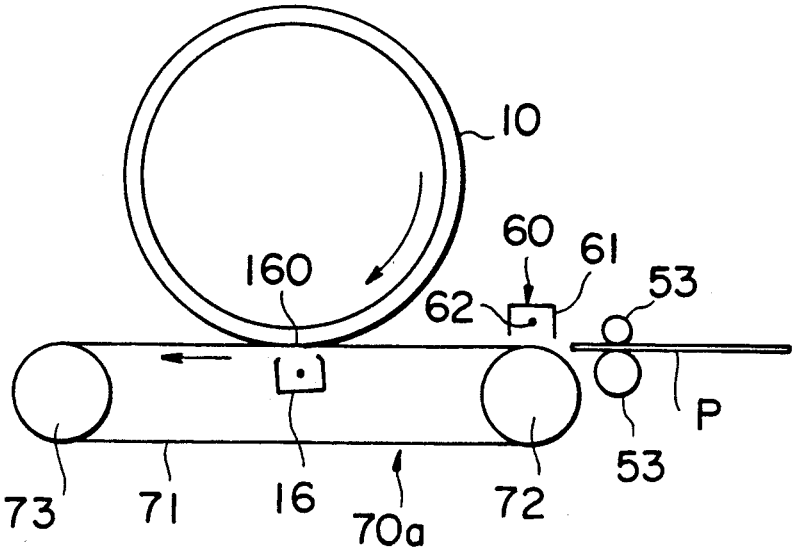
FIG. 8 is a schematic view showing an example of a conventional transferring belt device.

FIG. 6 represents a diagram showing special characteristics of Zener diode 67, and its axis of ordinate represents current I that flows into Zener diode 67, while the axis of abscissa represents voltage V impressed on Zener diode 67. When Zener diode 67 whose Zener voltage Vz is higher enough than voltage Vb between elastic brush 65 and the ground is used, it is possible to minimize leakage of charges for transferring.

With regard to the impression of bias voltage for aforesaid charging of transfer material, the control for the constant voltage is made so that the voltage may be kept within the range of 0.5-2.0 KV (same polarity as that of toner) when moving linear speed on the circumferential surface of photoreceptor 10 is 140 mm/sec, the width of an image is 300-350 mm, and the thickness of a sheet is 65 g/m$^2$.

When impressing voltage of $-1.5$ KV is needed for charging recording sheet P, if Zener diode 67 whose Zener voltage Vz is $-0.4$ KV is used and output voltage Vp of DC power source 66 for charging transfer material is caused to be $-1.9$ KV, the impression voltage for recording sheet P is;

$$(-1.9)\ \text{KV}-(-0.4)\ \text{KV}=-1.5\ \text{KV}$$

thus, the necessary impression voltage can be obtained. Further, when DC power source 66 is turned off, voltage Vb caused by transferring charge between elastic brush 65 and the ground is $-0.1$--$0.2$ KV owing to voltage drop caused by the resistance value of recording sheet P, and Zener leakage current (leakage current) is not more than 5 $\mu$A, thus the influence of leakage current is extremely small against ordinary discharge current 30 $\mu$A of transferring device.

Therefore, owing to the control for switching the charging current based on the humidity which easily affects, uniform charging on recording sheet P by means of aforesaid elastic brush 65 and the effect of Zener diode 67, it is possible to obtain the attraction and conveying force which are constantly firm and constant without being affected by ambient conditions.

Through the constitution mentioned above, the invention has realized an excellent transferring belt device wherein a recording sheet advances properly onto a transferring belt, uniform pre-transfer sheet charging is performed, the recording sheet is attracted to and conveyed by the transferring belt, uniform transferring is made at the transferring part, and generation of ozone that adversely affects the life of the transferring belt and human bodies is small.

Further, the invention causes a recording sheet to be separated easily because of a non-transferring area formed at the leading edge of the recording sheet.

Furthermore, the invention causes an elastic brush that is a conductive member to keep its elasticity constant for a long time and to be prevented from being contaminated for a uniform pre-transfer sheet charging, thus the recording sheet that is excellent in toner image transferring and in separation from a photoreceptor drum can be conveyed.

In addition to the foregoing, the invention provides an image forming apparatus wherein uniform charging on a transfer material and uniform charging for transferring can be performed without any complicated constitution, and the leakage of charges for transferring is extremely little even under the condition of high humidity, and thus, the characteristics of transferring as well as of separating are excellent.

What is claimed is:

1. An apparatus for forming an image on a recording material, comprising:

image carrying means having an image surface, for carrying a toner image on said image surface, said toner image being formed on said image surface by toner that is charged with a predetermined polarity;

transfer means for transferring said toner image from said image surface to said recording material at a transfer area of said image carrying means, said transfer means including:

a first roller and a second roller that are arranged so that said transfer area is located between said first and second rollers; and an endless belt member stretched so as to rotate around said first and second rollers to convey said recording material in a predetermined conveying direction to said transfer area;

said endless belt member being adapted to contact said image surface of said image carrying means at said transfer area to bring said recording material in contact with said toner image on said image surface of said image carrying means so that said toner image is transferred to said recording material;

said first roller being a conductive roller and being positioned in an upstream direction from said transfer area when viewed in said conveying direction;

voltage supply means;

a conductive member coupled to said voltage supply means, said conductive member contacting said endless belt member on said first roller, for directly charging said recording material conveyed on said endless belt member;

said voltage supply means supplying a bias voltage to said conductive member, said bias voltage having a potential relative to a reference potential level on said first roller, said bias voltage and said toner image having the same polarity relative to said reference potential level on said first roller; and a transfer electrode for applying a transfer voltage on said recording material and said toner image at said transfer area, wherein the polarity of said transfer voltage is opposite to the polarity of said toner image in relation to said reference potential level.

2. The apparatus of claim 1, further comprising positioning means for moving said belt member out of contact with said means having an image surface in the absence of said recording material at said transfer area.

3. The apparatus of claim 1, further comprising means for controlling said transfer electrode to prevent application of said transfer voltage onto a leading portion of said recording material.

4. The apparatus of claim 1, wherein said conductive member comprises an elastic brush.

5. The apparatus of claim 1, further comprising:

a power source; and a zener diode coupled between said conductive member and said power source.

6. The apparatus of claim 1, wherein said reference potential level on said first roller is substantially ground potential.

7. The apparatus of claim 1, further comprising actuating means for moving said conductive member substantially out of contact with said endless belt member in the absence of said recording material being conveyed on said endless belt member.

8. An apparatus for forming an image on a recording material, comprising:

image carrying means having an image surface, for carrying a toner image on said image surface;

transfer means for transferring said toner image from said image surface to said recording material at a transfer area of said image carrying means, said transfer means including:

a first roller and a second roller that are arranged so that said transfer area is located between said first and second rollers; and an endless belt member stretched so as to rotate around said first and second rollers to convey said recording material to said transfer area;

said endless belt member being adapted to contact said image surface of said image carrying means at said transfer area to bring said recording material in contact with said toner image on said image surface of said image carrying means so that said toner image is transferred to said recording material;

said first roller being positioned in an upstream direction from said transfer area when viewed in said conveying direction;

a conductive brush member in pressure contact with said endless belt member on said first roller, for directly charging said recording material conveyed on said endless belt member; and actuating means for moving said conductive brush member substantially out of pressure contact with said endless belt member in the absence of said recording material being conveyed on said endless belt member.

9. The apparatus of claim 8, further comprising positioning means for moving said belt member out of contact with said means having an image surface in the absence of said recording material at said transfer area.

10. The apparatus of claim 8, wherein said conductive member comprises an elastic brush.

11. The apparatus of claim 8, further comprising:

a power source; and a zener diode coupled between said conductive member and said power source.

12. An apparatus for forming an image on a recording material, comprising:

image carrying means having an image surface for carrying a toner image on said image surface;

transfer means for transferring said toner image from said image surface to said recording material at a transfer area of said image carrying means, said transfer means including:

a first roller and a second roller that are arranged so that said transfer area is located between said first and second rollers; and an endless belt member stretched so as to rotate around said first and second rollers to convey said recording material in a predetermined conveying direction to said transfer area;

said endless belt member being adapted to contact said image surface of said image carrying means at said transfer area to bring said recording material in contact with said toner image on said image surface so that said toner image is transferred to said recording material;

said first roller being positioned in an upstream direction from said transfer area when viewed in said predetermined conveying direction;

a conductive member contacting said endless belt member on said first roller, for directly charging said recording material conveyed on said endless belt member; and positioning means for moving said first roller together with said endless belt member between a first position and a second position, wherein when said endless belt member conveys said recording material, said first roller is moved by said positioning means to said first position so that said endless belt member comes in contact with both said image surface and said conductive member, and when said endless belt member does not convey said recording material, said first roller is moved by said positioning means to said second position so that said endless belt member is spaced from both said image surface and said conductive member.

13. The apparatus of claim 12, wherein said conductive member comprises an elastic brush.

14. The apparatus of claim 12, further comprising:

a transfer electrode for applying a transfer voltage to said recording material at said transfer area; and means for controlling said transfer electrode to prevent application of said transfer voltage onto a leading portion of said recording material.

15. The apparatus of claim 12, further comprising:

a power source; and a zener diode coupled between said conductive member and said power source.

16. The apparatus of claim 12, further comprising:

pressing means for pressing said elastic brush onto said endless belt member at said first position; and said pressing means slightly pressing the elastic brush to be in contact with said belt member at said second position.

* * * * *